US009750975B2

(12) United States Patent
Hunter, Jr.

(10) Patent No.: US 9,750,975 B2
(45) Date of Patent: Sep. 5, 2017

(54) PUSH-UP EXERCISE DEVICE

(71) Applicant: Stanley Russell Hunter, Jr., South Burlington, VT (US)

(72) Inventor: Stanley Russell Hunter, Jr., South Burlington, VT (US)

( * ) Notice: Subject to any disclaimer, the term of this patent is extended or adjusted under 35 U.S.C. 154(b) by 0 days.

(21) Appl. No.: 14/742,324

(22) Filed: Jun. 17, 2015

(65) Prior Publication Data

US 2016/0067546 A1 Mar. 10, 2016

Related U.S. Application Data

(60) Provisional application No. 62/048,427, filed on Sep. 10, 2014.

(51) Int. Cl.

| | |
|---|---|
| ***A63B 71/00*** | (2006.01) |
| ***A63B 26/00*** | (2006.01) |
| ***A63B 21/002*** | (2006.01) |
| ***A63B 23/12*** | (2006.01) |
| ***A63B 21/00*** | (2006.01) |
| ***A63B 21/068*** | (2006.01) |
| ***A63B 23/02*** | (2006.01) |

(52) U.S. Cl.

CPC ..... *A63B 23/1236* (2013.01); *A63B 21/0004* (2013.01); *A63B 21/0023* (2013.01); *A63B 21/068* (2013.01); *A63B 21/1469* (2013.01); *A63B 21/4035* (2015.10); *A63B 23/02* (2013.01); *A63B 23/0205* (2013.01); *A63B 2208/0295* (2013.01)

(58) Field of Classification Search

CPC . A63B 21/00; A63B 21/0004; A63B 21/1469; A63B 23/12; A63B 23/1209; A63B 23/1218; A63B 23/1227; A63B 23/1236

USPC ..... 482/23, 33, 34, 38–42, 91–96, 141, 142

See application file for complete search history.

(56) References Cited

U.S. PATENT DOCUMENTS

| | | | | |
|---|---|---|---|---|
| 2,832,595 A * | 4/1958 | Hastings | A63B 23/0405 | 482/131 |
| 3,792,725 A * | 2/1974 | Burgeson | B25G 3/34 | 473/310 |
| 3,821,824 A * | 7/1974 | Pilcher | B25D 1/00 | 125/41 |
| 3,901,296 A * | 8/1975 | Tomac | B25D 1/10 | 81/21 |

(Continued)

OTHER PUBLICATIONS

"Sinergy PUPs", Available as of Jan. 4, 2013 from https://www.youtube.com/watch?v=57sCUxFAJug.

*Primary Examiner* — Stephen R Crow
*Assistant Examiner* — Garrett Atkinson

(57) ABSTRACT

The present disclosure is directed to an exercise device that makes push-ups more physically challenging by reducing the area of contact that the push-up device makes with a surface while in use. A distal end of the device has a minimal radius of curvature, such that the surface area of the device in contact with the ground is minimized, thereby inducing instability. The user is challenged to overcome the inherent instability of the push-up device, thereby recruiting more muscle groups, placing higher demand on involved muscle groups, and practicing balance and proprioception. Additionally, by elevating the user's hands above the ground, the device can also enable the user's chest to move below the plane of the palms of his or her hands, thus inducing a larger range of motion with each push-up and further challenging the user's muscles.

14 Claims, 5 Drawing Sheets

(56) References Cited

U.S. PATENT DOCUMENTS 4,007,916 A * 2/1977 Maples ..... A01B 1/18 254/132
4,062,371 A * 12/1977 Bolen ..... A45B 3/04 135/66
4,317,529 A * 3/1982 Leibhard ..... B05C 17/00526 219/421
4,367,798 A * 1/1983 Sabol ..... A01K 13/002 168/45
4,796,648 A * 1/1989 Goulter ..... A45B 9/00 135/65
4,967,971 A * 11/1990 Smith ..... A61J 7/0007 241/169
5,865,204 A * 2/1999 Bracy ..... A45B 9/04 135/82
5,908,373 A * 6/1999 Pitre ..... A63B 21/154 482/52
5,934,300 A * 8/1999 Breton ..... A61H 3/068 135/65
5,975,601 A * 11/1999 Spear et al. ..... A01B 1/00 16/DIG. 19
6,176,319 B1 * 1/2001 Ehrmann ..... A01L 11/00 168/48.1
8,088,052 B1 * 1/2012 Sprague ..... A63B 21/0004 482/131
8,864,638 B2 * 10/2014 Ross ..... A63B 21/1469 482/141
9,056,222 B2 * 6/2015 Thomason ..... A63B 23/1236
9,199,117 B1 * 12/2015 Nicholas ..... A63B 21/0004
2005/0109152 A1 * 5/2005 Hsu ..... B62K 21/16 74/551.3
2007/0298947 A1 * 12/2007 Eksteen ..... A63B 21/0004 482/141
2009/0298656 A1 * 12/2009 Dannenberg ..... A63B 22/14 482/141
2010/0004105 A1 * 1/2010 Peddar ..... A63B 22/20 482/132
2010/0261590 A1 * 10/2010 Fares ..... A63B 21/00047 482/131
2010/0317496 A1 * 12/2010 Abranchess ..... A63B 21/0004 482/141
2011/0065555 A1 * 3/2011 Moskowich ..... A63B 23/12 482/141
2011/0166006 A1 * 7/2011 Howard ..... A63B 21/0004 482/141
2012/0065002 A1 * 3/2012 Cameron ..... A63B 57/50 473/408

* cited by examiner

PUSH-UP EXERCISE DEVICE

RELATED APPLICATIONS

This application claims the benefit of priority of U.S. Provisional Patent Application No. 62/048,427, filed Sep. 10, 2014, and titled "Exercise Device", which is incorporated by reference in its entirety.

FIELD OF THE INVENTION

The present invention generally relates to exercise devices. In particular, the present invention is directed to a Push-Up Exercise Device.

BACKGROUND

Numerous devices have been developed which are useful in exercising and strengthening the human body. These devices range from simple weights which are lifted to build muscle, to highly complex machines designed to exercise and build specific muscles. Exercise is an important and necessary part of many people's daily lives. In particular, push-ups are an exercise known to be beneficial for many people. During a push-up, a person typically positions their body in a prone position with their chest down and their hands on the floor below them. The exercise is performed by raising and lowering their body using their arms while resting either their feet or knees on the floor.

Push-ups are one of the oldest and perhaps most effective exercises. The push-up exercise is employed by the military and competitive sports teams around the world to gauge overall fitness. Conventional push-ups however, with the hands placed directly on a non-movable hard surface such as a floor, limit the possible benefits to the user.

SUMMARY OF THE DISCLOSURE

In a first exemplary aspect a push-up device for use on a surface for performing a push-up is disclosed, the push-up device comprising a handle having a first end, the handle sized and configured to isometrically challenge the grip and forearm muscles of a user; a support structure coupled to the first end, the support structure having a point opposite the first end for making contact with the surface, wherein the point has a radius of curvature that induces instability.

In another exemplary aspect, a push-up device for use on a surface for performing a push-up is disclosed, the push-up device comprising a handle having a first end, said handle sized and configured to isometrically challenge the grip and forearm muscles of a user, wherein said handle is substantially cylindrical; a support structure having a second end and a point opposite said second end, said point for making contact with the surface, wherein said point has a radius of curvature that induces instability, and wherein said second end has an end diameter that is substantially similar to said diameter of said handle.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
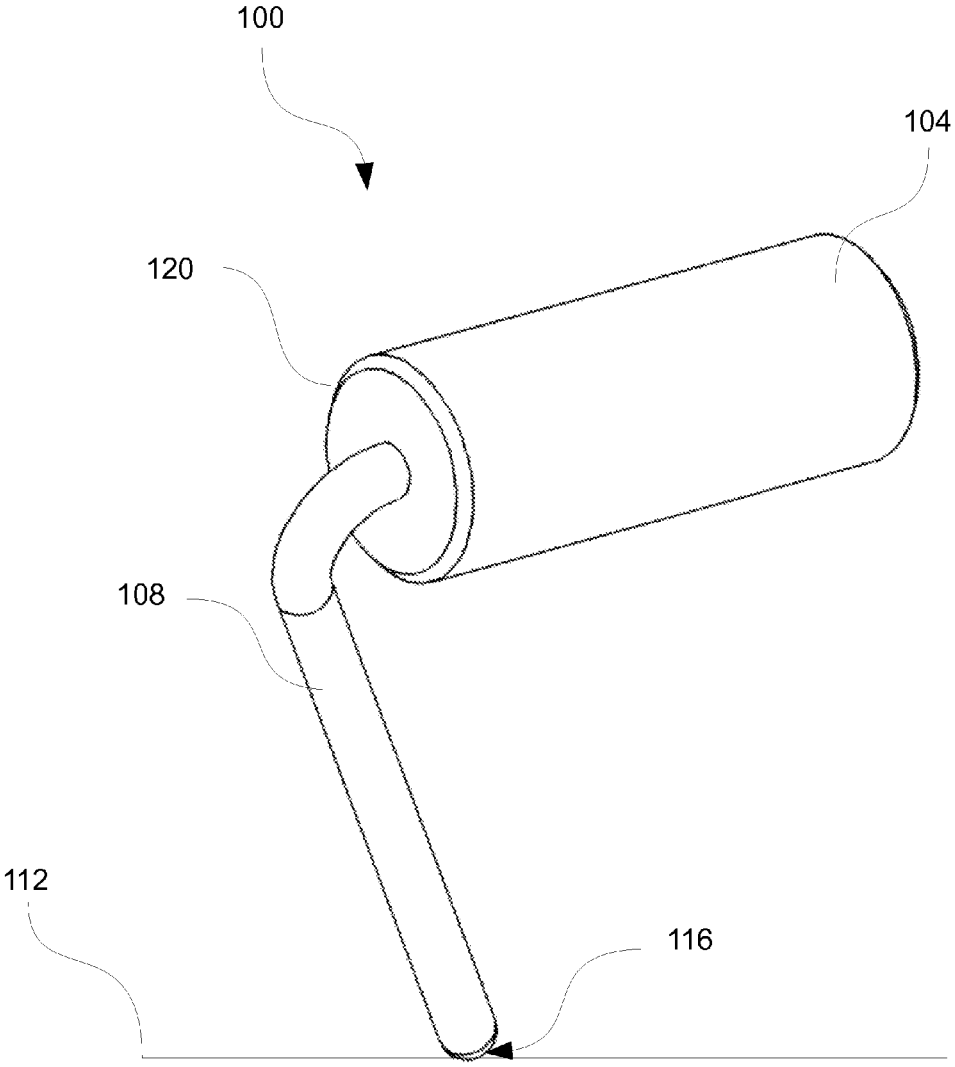
FIG. 1 is a perspective view of a push up device according to an embodiment of the present invention.
Figure 2:
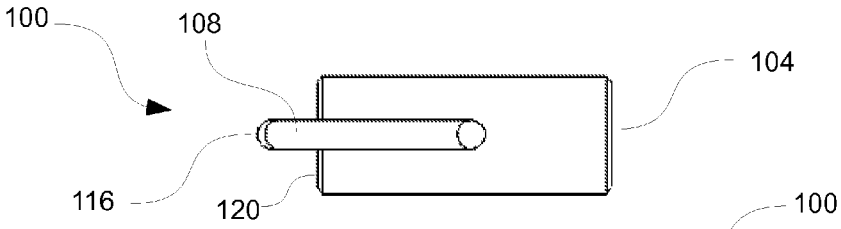
FIG. 2 is a bottom plan view of the exemplary push-up device of FIG. 1.
Figure 3:
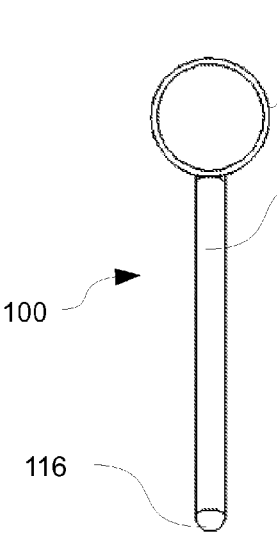
FIG. 3 is a back plan view of the exemplary push-up device of FIG. 1.
Figure 4:
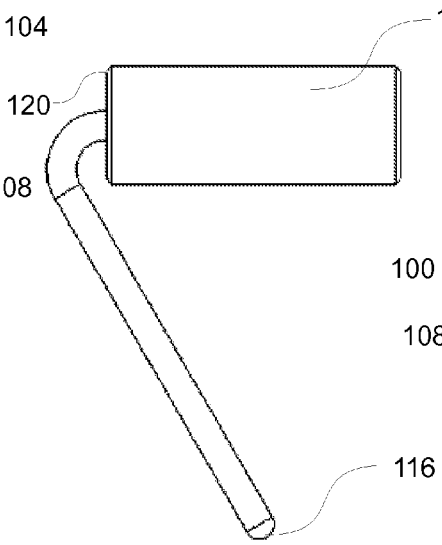
FIG. 4 is a side plan view of the exemplary push-up device of FIG. 1.
Figure 5:
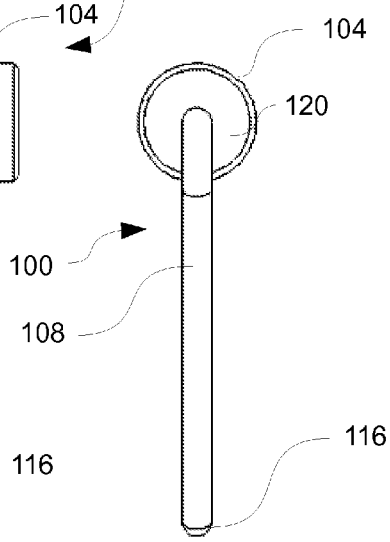
FIG. 5 is a front plan view of the exemplary push-up device of FIG. 1.
Figure 6:
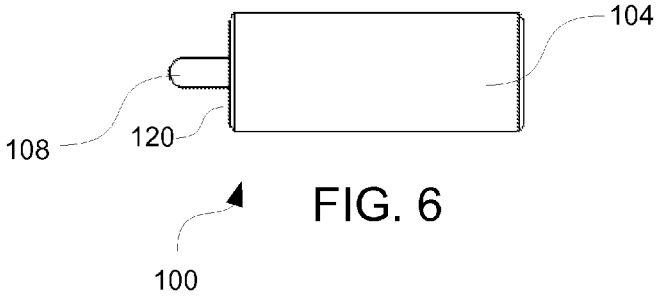
FIG. 6 is a top plan view of the exemplary push-up device of FIG. 1.

The present disclosure is directed to a push-up device that makes push-ups more physically challenging by reducing the area of contact that the push-up device makes with a surface while in use. In an exemplary embodiment, a distal end of the device has a minimal radius of curvature, such that the surface area of the device in contact with the ground is minimized, thereby inducing instability. Embodiments of the present disclosure involve the user overcoming the inherent instability of the push-up device, thereby recruiting more muscle groups, placing higher demand on involved muscle groups, and practicing balance and proprioception. The instability from the push-up device provides additional challenges to various muscle groups, in particular to the grip and forearm muscles. Additionally, by elevating the user's hands above the ground, the device can also enable the user's chest to move below the plane of the palms of his or her hands, thus inducing a larger range of motion with each push-up and further challenging the user's muscles. Embodiments of the push-up device as described herein are compatible with other push-up-like exercises including, but not limited to, planks, push-ups with the user's feet elevated, push-ups with the user's feet on an instability device such as a ball, jumping push-ups, and one-handed push-ups.

FIGS. 1-6 show an exemplary embodiment of a push-up device, push-up device 100, according to the present disclosure. Push-up device includes a handle 104 coupled to a support structure 108 that contacts a surface 112 at approximately a point 116, the point having a minimal radius of curvature such that there is minimal horizontal or rotational stability and there is substantial instability. Generally, support structure 108 is coupled to handle 104 such that the support structure does not create pressure points on the user's hand or fingers, including not creating uncomfortable or harmful pressure on the digital nerves, arteries, veins, or skin. In a preferred embodiment, in use, when there is horizontal or rotational deviation of the user's hand there is no significant change in the location of point 116 with surface 112.

Handle 104 is sized and configured to provide comfortable support for the user's hand, and, in use, supports a portion of the user's weight and conveys it to the rest of push-up device 100. In an exemplary embodiment, handle 104 is generally cylindrical with a diameter of about 2 inches and a length of about 5 inches, although larger or smaller cylindrical shapes could be employed as could longer or shorter handles, if for example, a user had a smaller or larger hand size. In certain embodiments, the diameter of handle 104 can be about 1 inch to about 3 inches. Changes in the diameter of handle 104 can offer different challenges to the user while still providing adequate support. For example, a small diameter can isometrically challenge the grip and forearm muscles in a position of greater flexion. As another example, a handle 104 with a relatively larger diameter isometrically challenges the grip and forearm muscles in a position of greater extension.

In another exemplary embodiment, handle 104 may be configured to have a form-fitting shape that conforms to the user's hand and fingers or handle 104 can include a form-fitting grip, such as, but limited to, a foam grip and a moldable grip. In yet another exemplary embodiment, handle 104 may have a padded surface (not shown). In yet a further exemplary embodiment, handle 104 may include a surface texture to reduce the potential for slippage between the handle and the user's hand. Handle 104 can be formed from materials such as, but not limited to, wood, metal, plastic, or any other material that resists deformation under the weight of the user and with sufficient surface friction (possibly with the addition of surface texture) to enable a secure grip.

Support structure 108 is coupled to handle 104, and when push-up device is in use, elevates handle 104 above surface 112 (floor, ground, etc.). In an exemplary embodiment, support structure 108 is coupled to handle 104 at a first end 120 of the handle such that the support structure does not interfere with the user's natural grip position. In this embodiment, support structure 108 minimizes the occurrence of pressure points.

As shown in FIG. 1 (and seen in FIG. 9), support structure 108 emerges from first end 120 to convey force from handle 104 to point 116 that is in contact with surface 112. In an exemplary embodiment, support structure 108 is generally cylindrical has a diameter of about 0.5 inch and a length of about 7 inches. Support structure 108 can be various shapes, different diameters, and different lengths. The shape, diameter, and length of support structure 108 should be sufficient to support a portion of the user's weight when doing a push-up and include point 116 as discussed herein. Thus, the thickness and height of support structure 108 may vary as a function of the intended weight that will be supported. In another exemplary embodiment, support structure 108 is sized and configured such that handle 104 is supported at different heights above the exercise surface. Resultant changes in height of handle 104 change the effective moment arm of push-up device 100, making push-ups less challenging when in a lower position (e.g., shorter support structure 108) and more challenging when in a higher position (e.g., longer support structure 108). Changes in height of handle 104 (based on changing the length of support structure 108) can also change the natural frequency of the oscillation of push-up device 100, with taller support structures generally causing lower frequency oscillations and shorter support structures causing higher frequency oscillations. Higher frequency oscillations challenge the user's nervous system to react more quickly to stabilize the device. In certain embodiments, support structure 108 has a length that provides a handle 104 elevation from about 4 inches to 18 about inches.

Support structure 108 can be constructed of steel or other materials having the appropriate strength characteristics. For example, support structure 108 may be made of other metals, plastic, composite, or any other materials sufficiently strong to support a portion of the weight of a user.

Point 116 is disposed on or is a portion of support structure 108 and induces instability of the push-up device when in use. In an exemplary embodiment, point 116 has a minimal radius of curvature, which allows push-up device 100 to support a user's weight via their hands while providing very little stability or corrective force should the user's hand deviate in any direction horizontally or rotationally. In the case of horizontal deviation by the user's hand, in an exemplary embodiment, point 116 is sized and configured so as to remain in its initial location, but not to provide corrective forces. In another exemplary embodiment, point 116 has a radius of curvature of about one-quarter inch, which for the intended use has a functional equivalence of about a zero radius curvature. In this embodiment, when support structure 108 has a diameter of about 0.5 inches, point 116 resembles a hemispherical tip.

Figure 7:
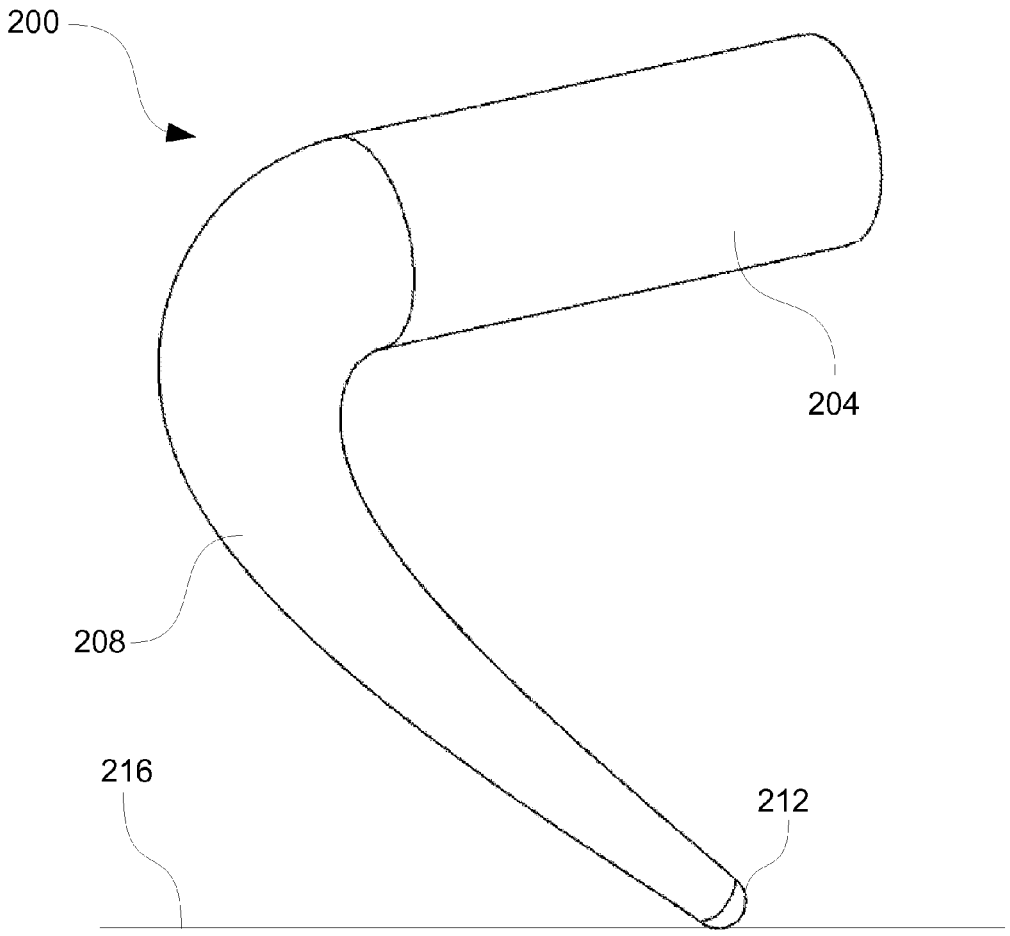
FIG. 7 is a perspective view of another embodiment of a push up device according to an embodiment of the present invention.

Turning now to FIG. 7, there is shown another exemplary embodiment of the present invention, push-up device 200. Push-up device 200 includes a handle portion 204 and a support portion 208 with a point 212 for contacting a surface 216. While handle portion 204, support portion 208, and point 212 can have many of the attributes discussed above with respect to handle 104, support structure 108, and point 116, as shown in FIG. 7, handle portion 204 and support portion 208 can be a continuous/unitary structure and the thickness of the support portion can be tapered to point 212 such that proximate the handle portion, the support portion is about the same size and shape (e.g., same diameter in the case of a cylindrical handle portion). In an exemplary embodiment, the thickness of support portion 208 can vary in approximate proportion to the mechanical moment that must be resisted at that portion of the support structure. In an exemplary embodiment, handle portion 204, support portion 208, and point 212 can be manufactured together, such as being thermoformed or injection-molded.

Figure 8:
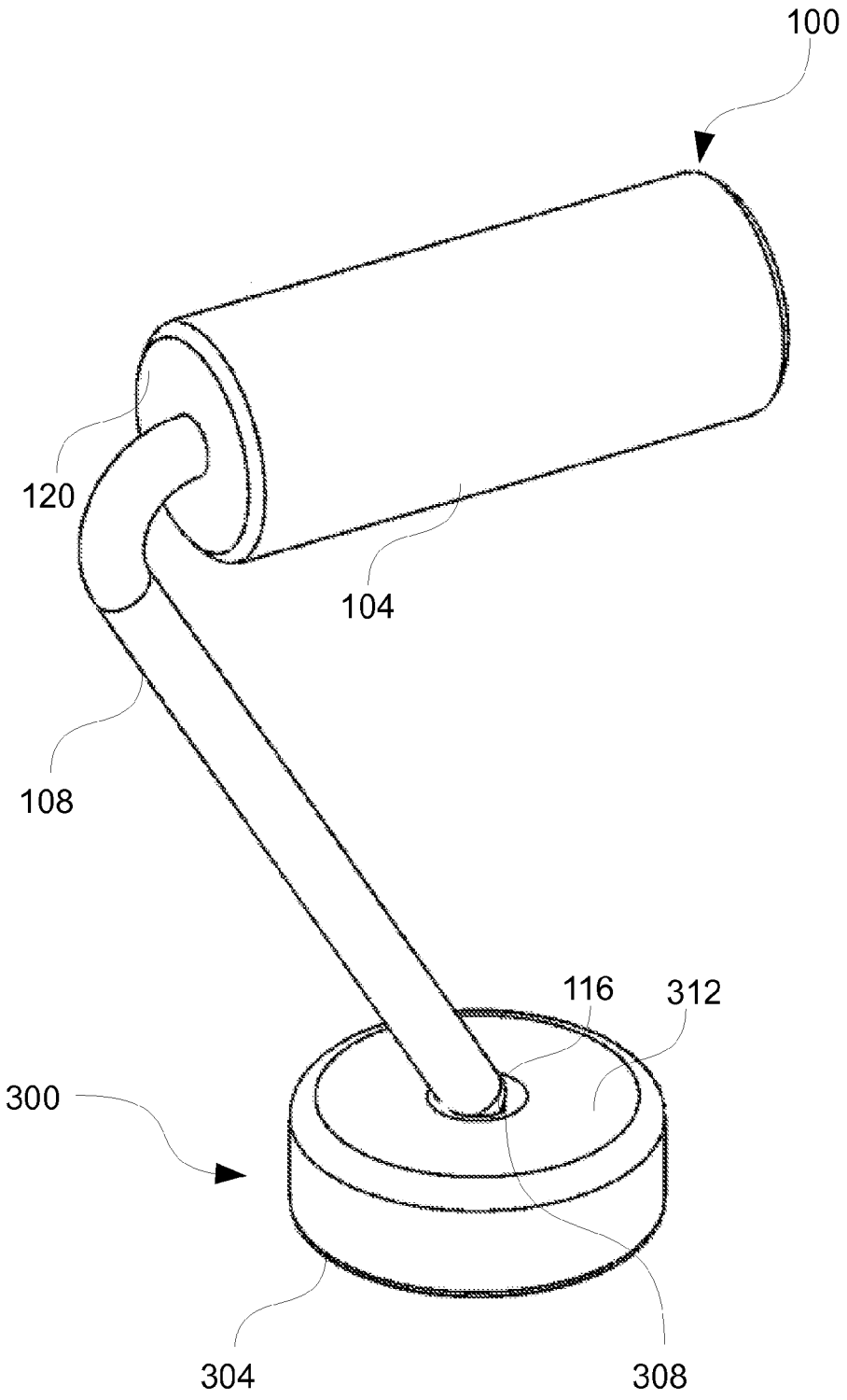
FIG. 8 is a perspective view of an embodiment of a push up device including a dispersion device according to an embodiment of the present invention.

A push-up device, such as push-up device 100 or 200, (push-up device 100 shown in FIG. 8) can be used in conjunction with a dispersion device, 300, as shown in FIG. 8. Dispersion device 300 generally enables the high pressure concentration of point 116 of push-up device 100 to be dispersed on a surface, such as surface 112 (FIG. 1). In an exemplary embodiment, dispersion device 300 has a substantially flat lower surface 304 that rests on a surface and a divot 308 on an upper surface 312 within which point 116 (or point 212) can freely rotate without translating horizontally. Dispersion device 300 can reduce scratching a floor surface and reduce the potential for point 116 to slip along surface. In a preferred embodiment, dispersion device 300 has a diameter of about 3 inches. Dispersion device 300 can be made of any material with adequate strength to avoid deformation under pressure. In an exemplary embodiment, lower surface 304 has adequate coefficient of friction with the surface to avoid slippage. In a preferred embodiment, dispersion device 300 is made of solid vulcanized rubber. In another exemplary embodiment, dispersion device 300 can be a soft, non-slip material, such as rubber, that is affixed to point 116.

Figure 9:
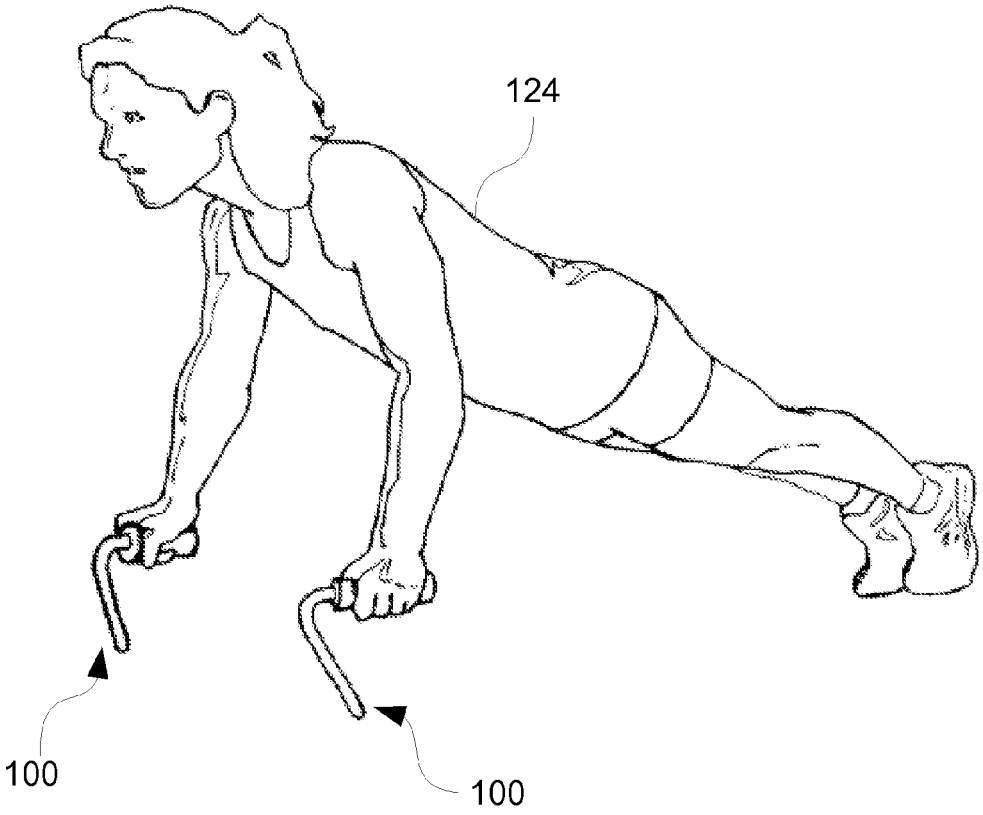
FIG. 9 is a perspective view of an exemplary embodiment of the present invention in use.

An exemplary embodiment of the push-up device 100 in use is illustrated in FIG. 9. As shown, a user 124 orients themselves in a push-up position, as described above. With two push-up devices, such as push-up device 100, (or if capable, with only one push-up device), the user grips the push-up device handle (one in each hand) (although shown in FIG. 9 with the support structure proximate the user's index finger, push-up device 100 can be gripped with the support structure proximate the user's pinky finger). The user then places each push-up device's point on the ground/ floor/surface and raises her torso to push-up position, e.g., with her arms extended. The user then descends her torso, flexing in a natural manner at her wrists, elbows, shoulders, and scapulothoracic joints, as low to the ground/floor/surface as is possible/comfortable, and then raises her torso to the starting position. The user can place the push-up devices closer together or farther apart, as well as closer or farther from the location of her feet, to engage different groups of muscles.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A push-up device for use on a surface for performing a push-up, the push-up device consisting essentially of:

a single handle having a first end, said handle sized and configured to isometrically challenge the grip and forearm muscles of a user; and a support structure coupled to said first end at an acute angle, said support structure having a point opposite said first end, said point being sized and configured to remain in an initial location, wherein when in use the device makes contact with the surface through said point and at the initial location on the surface, wherein said point has a radius of curvature that induces instability when the device is in use, wherein said radius of curvature is such that said point has a hemispherical tip, wherein said support structure is a single cylindrical rod member extending from said first end to said single point and has a length such that, when the push-up device is in use, the cylindrical rod member raises said handle above the surface by greater than 4 inches and less than 18 inches, and wherein the device is configured for performing a push-up and said handle is configured to be parallel to the surface when a user is performing a push-up.

2. A push-up device according to claim 1, wherein said handle is cylindrical.

3. A push-up device according to claim 2, wherein said handle has a diameter of greater than 1 inch and less than 3 inches.

4. A push-up device according to claim 2, wherein said handle has a diameter of greater than 1 inch.

5. A push-up device according to claim 1, wherein said handle has a shape that conforms to a user's hand and fingers.

6. A push-up device according to claim 1, wherein said radius of curvature is ¼ inch.

7. A push-up device according to claim 1, wherein said handle and said support structure are a unitary body.

8. A push-up device according to claim 7, wherein said support structure has an upper end opposite said point, wherein said handle is cylindrical, and wherein said upper end has a diameter equal to a diameter of said handle.

9. A push-up device for use on a surface for performing a push-up, the push-up device consisting essentially of:

a single handle having a first end, said handle sized and configured to isometrically challenge the grip and forearm muscles of a user, wherein said handle is cylindrical and has a diameter; and a support structure having a second end attached to said first end of said handle at an acute angle and a point opposite said second end, said point including a hemispherical tip and configured to remain in an initial position on the surface when in use, wherein said support structure is a single cylindrical rod member extending from said first end to said single point and has a length such that, when the push-up device is in use, the cylindrical rod member raises said handle above the surface by greater than 4 inches and less than 18 inches;

wherein the device is configured for challenging a user performing a push-up, wherein said point has a radius of curvature that induces instability, and wherein said second end has an end diameter that is equal to said diameter of said handle, and wherein said handle is configured to be parallel to the surface when a user is performing a push-up.

10. A push-up device according to claim 9, wherein the diameter of said handle is greater than 1 inch and less than 3 inches.

11. A push-up device according to claim 9, wherein said handle conforms to a user's hand and fingers.

12. A push-up device according to claim 9, wherein said radius of curvature is ¼ inch.

13. A push-up device according to claim 9, wherein said handle and said support structure are a unitary body.

14. A push-up device for performing a push-up on a surface, the push-up device comprising:

a handle having a first end, said handle sized and configured to isometrically challenge the grip and forearm muscles of a user;

a support structure coupled to said first end, said support structure having a point opposite said first end, wherein said support structure is a cylindrical rod member extending from said first end to said single point and has a length such that, when the push-up device is in use, the cylindrical rod member raises said handle above the surface by greater than 4 inches and less than 18 inches; and a dispersion device with a flat bottom end and a top end, said top end including a divot for receiving said point and said bottom end contacting the surface when the push-up device is in use, wherein, when in use, said point can freely rotate within said divot without translating horizontally, wherein said point has a radius of curvature that induces instability when the push-up device is in use, and wherein the push-up device is configured for performing a push-up.

* * * * *